US009371705B2

(12) United States Patent
Birkeland et al.

(10) Patent No.: US 9,371,705 B2
(45) Date of Patent: Jun. 21, 2016

(54) DEVICE FOR CONNECTION AND DISCONNECTION OF AN ACTIVE HEAVE COMPENSATOR

(71) Applicant: Castor Drilling Solution AS, Kristiansand S (NO)

(72) Inventors: Runar Birkeland, Mandal (NO); Paal Anders Taraldrud, Tveit (NO)

(73) Assignee: Castor Drilling Solution AS, Kristiansand S (NO)

( * ) Notice: Subject to any disclaimer, the term of this patent is extended or adjusted under 35 U.S.C. 154(b) by 0 days.

(21) Appl. No.: 14/649,798

(22) PCT Filed: Dec. 12, 2013

(86) PCT No.: PCT/EP2013/076375
§ 371 (c)(1),
(2) Date: Jun. 4, 2015

(87) PCT Pub. No.: WO2014/090944
PCT Pub. Date: Jun. 19, 2014

(65) Prior Publication Data

US 2015/0315856 A1 Nov. 5, 2015

(30) Foreign Application Priority Data

Dec. 12, 2012 (NO) ..... 20121501

(51) Int. Cl.
*E21B 19/09* (2006.01)
*E21B 19/00* (2006.01)

(52) U.S. Cl.
CPC ..... *E21B 19/09* (2013.01); *E21B 19/006* (2013.01)

(58) Field of Classification Search
CPC ..... E21B 19/09; E21B 19/006
USPC ..... 166/355; 267/125
See application file for complete search history.

(56) References Cited

U.S. PATENT DOCUMENTS

| | | | | | |
|---|---|---|---|---|---|
| 3,714,995 | A | | 2/1973 | Hanes et al. | |
| 3,791,628 | A | * | 2/1974 | Burns | B66D 1/48 254/277 |
| RE28,218 | E | * | 10/1974 | Hanes et al. | E21B 19/09 175/27 |
| 3,946,559 | A | | 3/1976 | Stevenson | |
| 4,176,722 | A | * | 12/1979 | Wetmore | E21B 19/09 166/355 |
| 4,886,397 | A | * | 12/1989 | Cherbonnier | E21B 19/09 114/264 |
| 2005/0147473 | A1 | * | 7/2005 | Pallini | E21B 19/006 405/224.4 |

* cited by examiner

FOREIGN PATENT DOCUMENTS

| | | | |
|---|---|---|---|
| CN | 101130949 | A | 2/2008 |
| CN | 101798909 | A | 8/2010 |
| EP | 0141570 | A1 | 5/1985 |
| GB | 2053127 | A | 2/1981 |
| NO | 329688 | B1 | 11/2010 |
| WO | WO-2007139394 | A1 | 12/2007 |

OTHER PUBLICATIONS

Strømmen, Henrik, "International Search Report," prepared for PCT/EP2013/076375, as mailed Oct. 29, 2014, four pages.

*Primary Examiner* — James G Sayre
(74) *Attorney, Agent, or Firm* — Winstead PC

(57) ABSTRACT

A device for connecting and disconnecting an active compensator actuator or additional passive compensator actuators from a passive compensated load bearing unit during operation and at static suspended condition. The device comprises a connection arrangement (7), which is operatively connected to a crown block. The connection device (7) is adapted to selectively grip a second end (18) of the heave compensator actuator (1). The device comprises further a safety arrangement (6) which are adapted to selectively grip the second end (18) of the heave compensator actuator (1) when it is not in engagement with the connection arrangement (7), the device comprises also a support arrangement (2), which is adapted to support the heave compensator actuator when it is not connected to the crown block (8).

6 Claims, 6 Drawing Sheets

DEVICE FOR CONNECTION AND DISCONNECTION OF AN ACTIVE HEAVE COMPENSATOR

The present invention relates to a device for use on an offshore vessel, more precisely the invention relates to a device for use in connection with an active wave- or heave compensator. Compensator systems like that are often arranged together with fixed passive compensators at the top of a derrick or at the bottom of the derrick near the hoisting dead end on a floating drilling installation.

BACKGROUND OF THE INVENTION

An active heave compensator usually comprises a linear actuator, typically a hydraulic cylinder construction with three chambers. This construction has typically axial movement of about 8 meter. The actuator could also be of another form of linear actuator, such as electric powered. This active compensator actuator is generally related to a passive heave compensation machine, called drill string compensator or passive compensator. The passive compensator exploit the gas compressibility of air or nitrogen in large pressurized containers (APV's) which are hydraulically connected to one or more hydraulic cylinders via piston accumulator(s). The piston accumulator(s) is acting as a phase separator between the pressurized gas volume and the oil-filled hydraulic cylinders. The hydraulically cylinders balance thereof the load in this passive compensator and offsets most of the vessel heave motions using spring force from the pressurized gas volume. A typical drill string compensator manipulates the load in that the hydraulic cylinders in the passive compensator are mechanically connected to a movable crown block in the draw work system of the derrick. The actuator of the active compensator is also connected to and manipulates actively the movable crown block with a smaller force that helps to reduce the load fluctuation and deviation position from the passive compensator in that it outweights the friction in the passive compensator. A control system regulates the force—and position load based on real time measurements from an acceleration sensor (MRU) on the vessel. In this way the performance of the total heave compensator system are improving in that all heave induced influences are eliminated. This is important when delicate operations are carried out on the seabed or in the well.

In drilling rigs which are equipped with top-mounted active heave compensation actuator and passive heave compensator, the actuator of the active compensation is usually connected permanently to the movable part of the passive compensation machine.

The total amount of time the drilling rig is operational with active heave compensation is often limited compared with the time it is operational with passive heave compensation alone. The actuator of the active compensator is hence driven out and in by the spring force in the passive compensator in a greater portion of the time.

To minimize the abrasion and achieve optimal operation, it is advantageous to have an arrangement where the actuator of the active compensation can be connected and disconnected when it is needed. Such an arrangement will increase the lifetime of the active compensator actuator and increase the capacity of the passive compensator.

SUMMARY OF THE INVENTION

The invention provides a device for connecting and disconnecting an active heave compensator actuator or additional passive compensator actuators which is operatively connected with a fixed structure at its first end. The device is distinctive in that the heave compensator actuator comprises a connection device which are operatively connected to a crown block or other load carrying device, said connection device being adapted to selectively grip a second end of the heave compensator actuator, and that it further comprising a safety device being adapted to selectively grip the heave compensator actuator second end when it is not in engagement with the connection device.

Preferable embodiments of the device are defined in the dependent claims, to which reference is made The purpose of the device according to the present invention is to permit connection and disconnection of the active heave compensator actuator or additional passive compensator actuators against the movable crown block or other load carrying device which is passively compensated by fixed passive compensator actuators. The arrangement protect also against collisions between the movable end of the active compensator actuator and the movable crown block attached to the passive compensator. Usually the active compensator actuator is flexibly supported using a gimbal-mounting towards the tower structure. This is to prevent transmission of lateral forces to the active compensator actuator when the movable crown-block is driven in and out, this may damage the seal assembly and the rod, because there always will occur lateral movement of the crown block. When the rod end on the active compensator actuator is disconnected from the crown block, the arrangement will need a support mechanism to prevent that the active compensator actuator tilt. In addition the support arrangement contribute to a possible subsequent connection, in that the active compensator actuator is aligned to obtain the right entry (in this case vertical) of the connection device at the end of the actuator rod against the connecting arrangement on the typically passively compensated crown block.

The arrangement has the capability to connect and disconnect the dynamically loaded load bearing device, both when the actuator is set in motion or it is in stationary state.

FIGURES

Figure 4A:
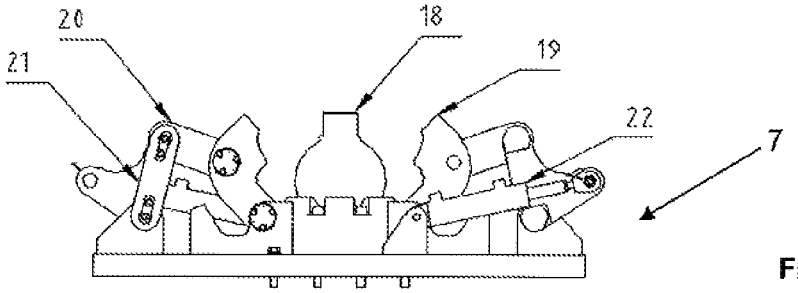
Figure 4B:
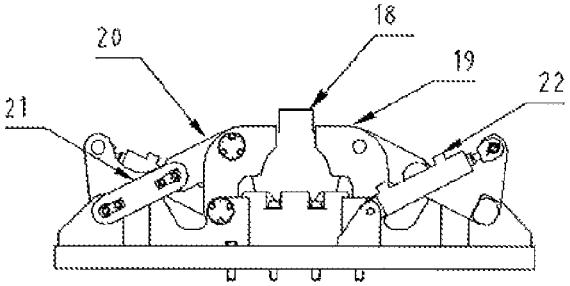
Figure 4C:
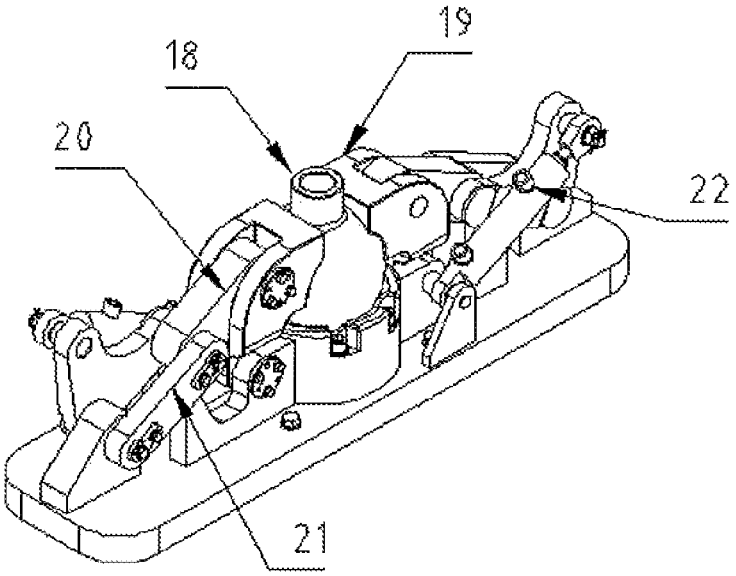

FIG. 4 shows a connection arrangement 7 mounted on the movable passively compensated crown block for connection and disconnection of the active compensator actuator, a) shown in open position, b) shown in closed position, c) isometric view of the closed position.

Figure 1:
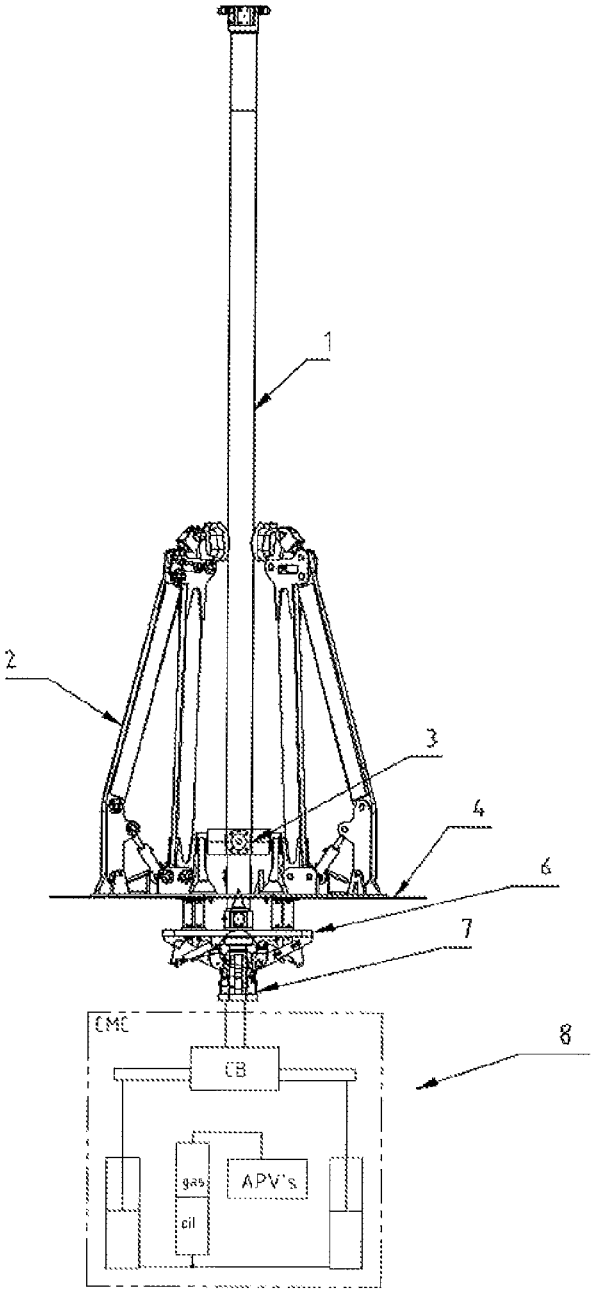
FIG. 1 shows a schematic view of an active compensator actuator with disconnection arrangement fitted, and attached a passive compensator with movable crown block
Figure 5A:
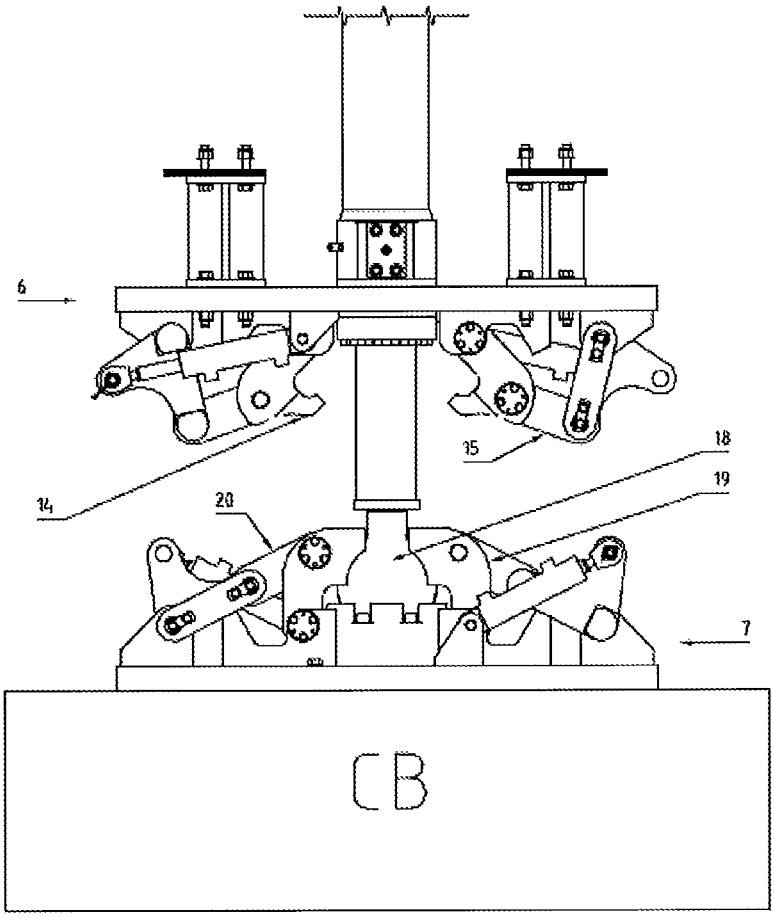
Figure 5B:
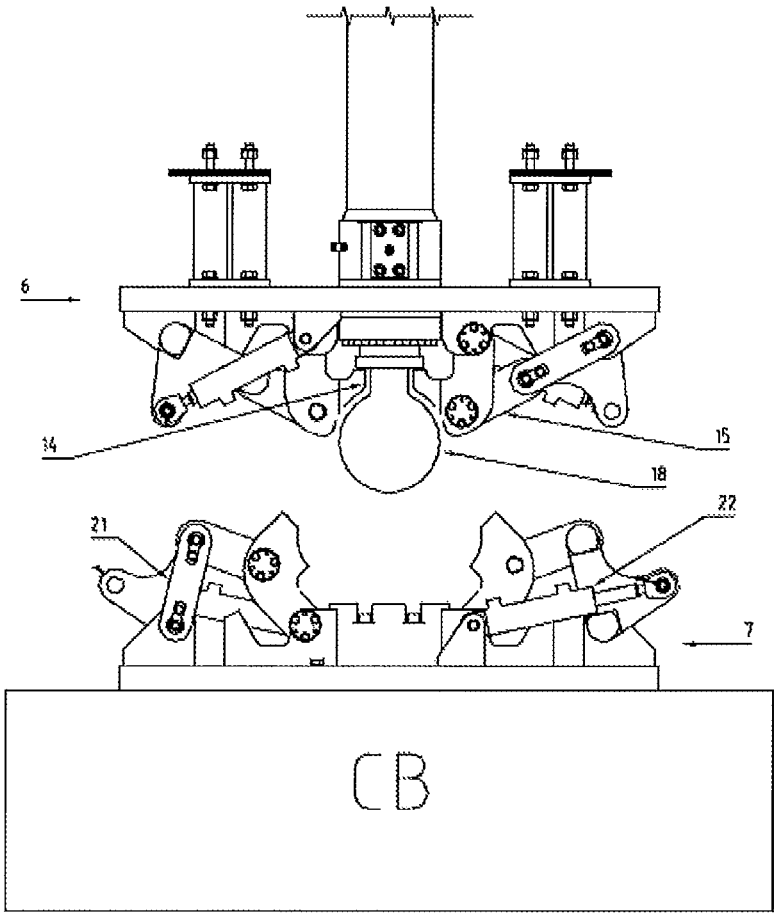

FIG. 5*a* and FIG. 5*b* shows an augmented view the arrangement shown in FIG. 1.

DETAILED DESCRIPTION OF THE INVENTION

Reference is made to FIG. 1, illustrates the combination of connection and disconnection arrangements 2, 6, 7, 8 arranged on a tower or a derrick structure 4 and in conjunction with the active compensator actuator 1 which are flexible supported via a gimbal 3 and connected to a movable crown block in a passive compensator 8. The arrangement comprises an actuated supporting device 2, a safety device 6 and a connection device 7. The safety device 6 and the connection device 7 being adapted to selectively grip an adapter head 18.

The supporting device 3, the safety device 6, the connection device 7 and the connection with the adaptor head is further described in the following FIGS. 2-4.

FIG. 2 shows the supporting arrangement 2.

The actuated supporting device 2 is mounted at or around the active compensator actuator 1. The supporting device 2 is connected to the derrick structure 4 with a hinged connection.

The supporting device 2 comprises three adjustable contact supports 9 that are run or placed against the stationary end of the active compensator actuator 1 using an arm construction. The arm construction comprising one main arm 10 and two linked arms 11, 13, positioned at an angle relative to the main arm 10 The main arm 10 and the linked arm 11 are hingedly connected at an upper end of the supporting device 2. The link 13 is connected to link arm 10 and supported in the lower end of device 2. The contact supports 9 are activated by hydraulically or electrically adjustable actuators 12.

Figure 2A:
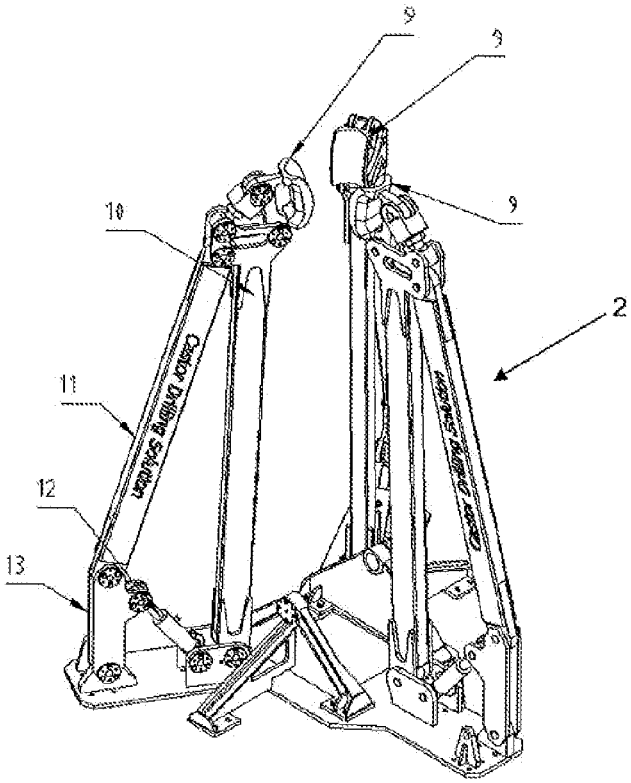
FIG. 2 shows a supporting arrangement 2 to support and secure the active compensator actuator, a) shown in open position, b) shown in closed position.
Figure 2B:
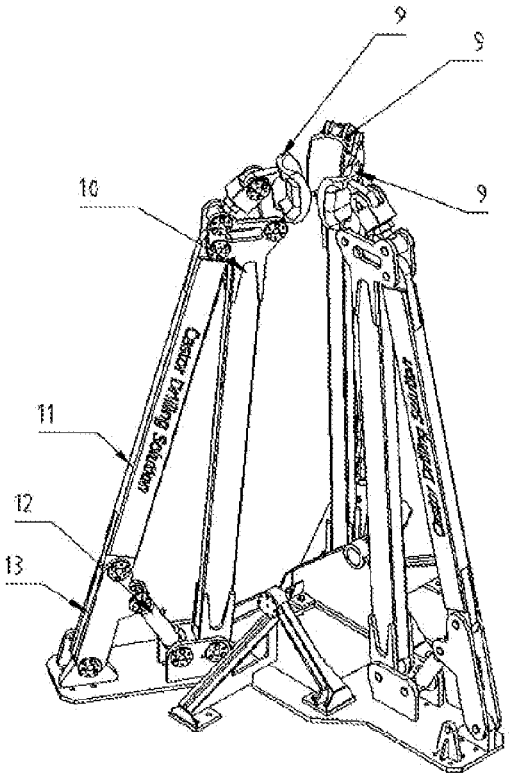

The function of the supporting device 2 is to align the actuator when connecting and disconnecting as well as being a lateral support to the active compensator actuator 1 when this is disconnected. This is shown in FIG. 2*b*. When the active compensator actuator 1 is connected to the crown block, the supporting arrangement 2 will be pulled away from the compensator actuator 1 and the contact supports 9 are not in contact with the compensator actuator 1. This is shown in FIG. 2*a*.

Figure 3A:
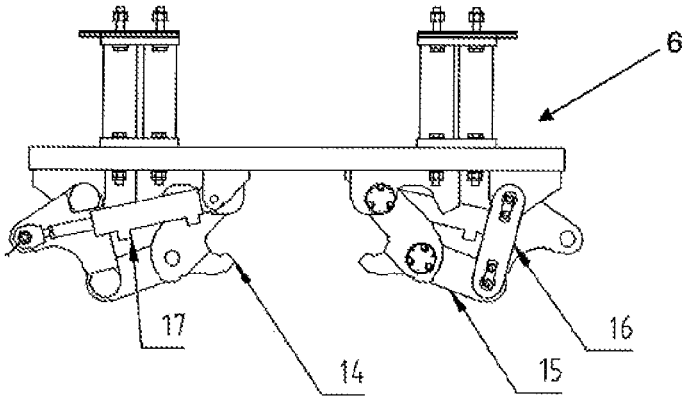
FIG. 3 shows a safety device 6 a) shown in open position, b) shown in closed position, c) isometric view of the closed position.
Figure 3B:
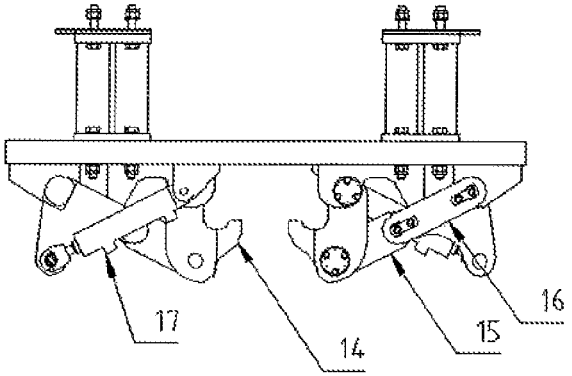
Figure 3C:
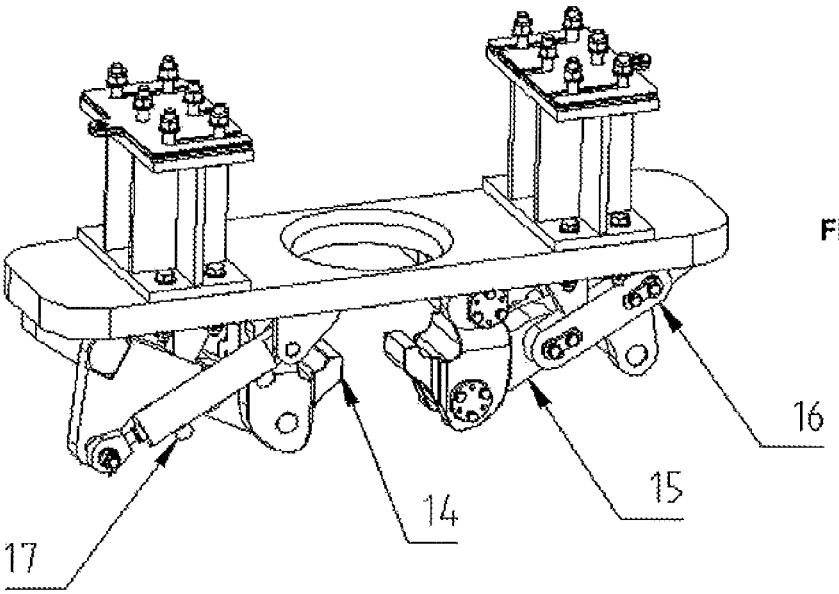

FIG. 3 shows the safety device 6. The safety device aims to ensure that the active compensator actuator rod 1 do not move when it is disconnected from the movable crown block in the passive compensator 8. The safety arrangement 6 comprises one or more gripping arms with parts 14-17 arranged to selectively grip a flange (not shown) on the adaptor head 18, the adaptor head 18 is spherical or has another shape and is connected to the movable part (the rod end) of the active compensator actuator 1. The gripping arms comprises an arm construction having a gripper 14 and two linked arms 15, 16 which are activated by one or more hydraulically or electrically adjustable actuators 17. The safety device comprises at least two arm constructions. FIG. 3*a* shows the safety device 6 in an open position where the grapplers 14 are not in contact with the adaptor head 18.

FIG. 3*b* shows the safety arrangement in a closed position where the grapplers 14 engaging the flange of the adaptor head 18.

The safety device 6 is also attached to the derrick structure 4.

FIG. 4 shows the connection device 7. The connection device 7 is connected to the movable and passively compensated crown block 8 in order to connect or disconnect the adaptor head 18 on the active compensated actuator 1, both when the passive compensated crown block 8 are in motion or in stationary condition. Using the connection device 7, the active compensator actuator 1 is connected to the crown block and will thus be able to be set in an active condition. The connection arrangement 7 is adapted to selectively grip a flange or spherical ball connector on the adaptor head 18—, the adaptor head fixedly connected to the active compensator actuator 1 movable rod end (not shown). The connection device 7 comprises one or more gripping arms with parts 19-22 that are arranged to selectively grip a the flange or spherical ball connector on the compensator actuator adaptor head 18. The arm construction comprising a grappler 19 and two link arms 20, 21. These are activated by hydraulically or electrically adjustable actuators 22.

FIG. 4*a* shows the connection device 7 in an open position where the grapplers 19 are not in contact with the adaptor head 18.

FIG. 4*b* shows the safety connection device 7 in a closed position where the grapplers 19 engaging the flange of the adaptor head 18.

When the adaptor head 18 is connected to the connection device 7 the rod end (not shown) of the active compensator actuator 1 may be hydraulically driven in and out. When the adaptor head 18 is connected to the safety device 6, the rod end (not shown) of the active compensator actuator 1 is held in a fixed position. The principle is illustrated in FIG. 5*a* and 5*b*. The connection device is oriented below the actual position of the connection device as shown in FIG. 1.

The present invention has been described with reference to some preferred embodiments and some drawings for the sake of understanding only and it should be clear to persons skilled in the art that the present invention includes all legitimate modifications within the ambit of what has been described hereinbefore and claimed in the appended claims. Henceforward this connection and disconnection device can also be used for passive compensator actuators in passive compensators comprising two or more passive compensator actuators. This to allow using only the number of compensator actuators needed to achieve the necessary compensation force.

The invention claimed is:

1. An arrangement on a derrick structure for connecting and disconnecting a heave compensator actuator, said heave compensator actuator is operatively connected with a fixed structure at its first end, the arrangement comprising:

a connection device;

a safety device;

wherein said connection device being operatively connected to a crown block or other load carrying device;

wherein said connection device being adapted to selectively grip an adaptor head of the heave compensator actuator; and wherein said safety device being attached to the derrick structure and being adapted to selectively grip the adaptor head of the heave compensator actuator, when said adaptor head is not in engagement with the connection device, so that the heave compensator actuator is held stationary relative to said fixed structure when disconnected from said connection device.

2. The arrangement according to claim 1, wherein the connection device and the safety device are provided with gripping arms which are adapted to engage the adaptor head of the heave compensator actuator.

3. The arrangement according to claim 1, comprising a supporting arrangement which is adapted to support the heave compensator actuator laterally when not connected to the crown block or other load carrying device.

4. The arrangement according to claim 1, wherein the connection device and the safety device are adapted to be alternatingly connected and disconnected during operation.

5. The arrangement according to claim 1, wherein the crown block is operatively connected to a passive compensator.

6. The arrangement according to claim 1, wherein the adaptor head of the heave compensator actuator comprises a spherical adaptor head adapted to be gripped by the connection device and the safety device.

* * * * *